US007178863B1

(12) United States Patent
Norval

(10) Patent No.: US 7,178,863 B1
(45) Date of Patent: Feb. 20, 2007

(54) ENLARGED FOLDABLE CHAIR SYSTEM

(76) Inventor: Charles L. Norval, 270 Promerade Dr., Apt. 204, Dunedin, FL (US) 34698

( * ) Notice: Subject to any disclaimer, the term of this patent is extended or adjusted under 35 U.S.C. 154(b) by 2 days.

(21) Appl. No.: 11/185,315

(22) Filed: Jul. 20, 2005

(51) Int. Cl.
*A47C 4/00* (2006.01)
*A47C 4/28* (2006.01)
*A47C 4/30* (2006.01)
*A47C 4/42* (2006.01)

(52) U.S. Cl. ..... 297/29; 297/39; 297/40; 297/45

(58) Field of Classification Search ..... 297/39, 297/40, 45, 51, 29
See application file for complete search history.

(56) References Cited

U.S. PATENT DOCUMENTS 849,584 A * 4/1907 Van Valkenburg ..... 297/29
1,858,254 A 5/1932 Uline
1,919,110 A * 7/1933 Horvath ..... 297/29
2,704,569 A 3/1955 Salzer
2,747,653 A * 5/1956 Obradovich ..... 297/29
2,800,951 A * 7/1957 Szabo ..... 297/29
3,414,321 A * 12/1968 Beck ..... 297/29
5,529,375 A 6/1996 English
5,570,928 A 11/1996 Saunton et al.
6,231,119 B1 5/2001 Zheng

* cited by examiner

*Primary Examiner*—Rodney B. White
(74) *Attorney, Agent, or Firm*—Edward P. Dutkiewicz

(57) ABSTRACT

A seat section and a back section are provided with a rod pivotably forming the rear end of the seat section and the lower end of the back section. A pair of parallel arm rests are also provided. A forward support has a central extent and end extents pivotably coupled to forward pivot points of the arm rests. A rearward support has a central extent and end extents coupled to intermediate pivot points of the arm rests. A front brace is formed of an upper component rotatably coupled to the seat section and a lower component rotatably coupled to the forward support.

4 Claims, 4 Drawing Sheets

FIG 1
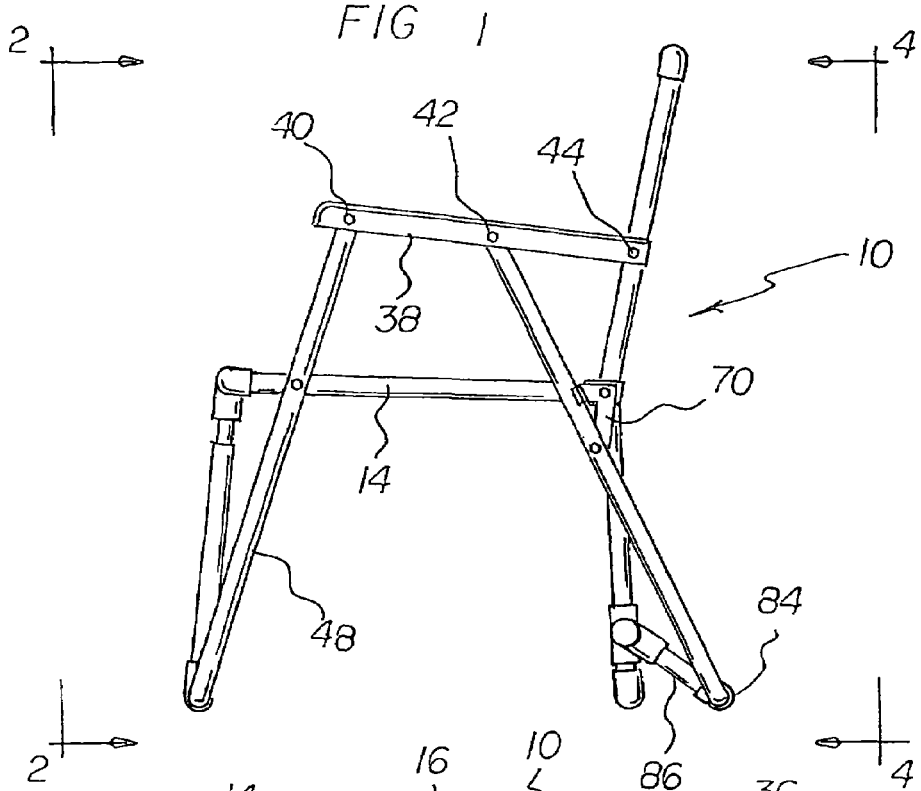
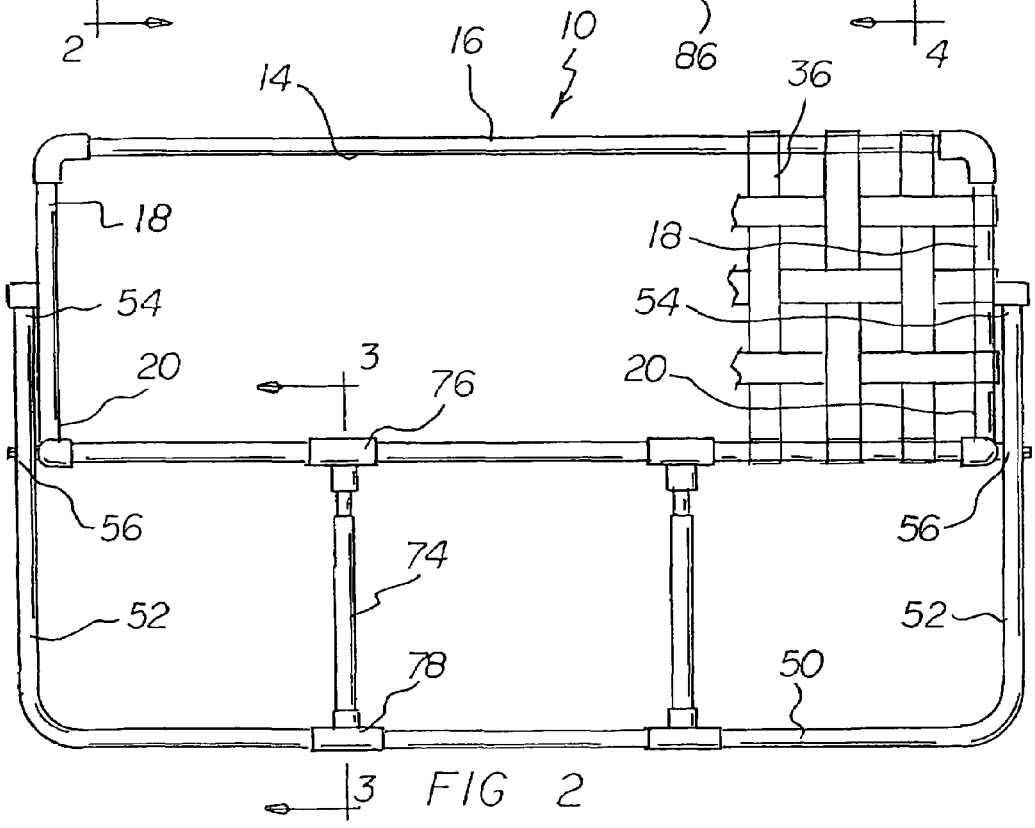
FIG 2

FIG 5
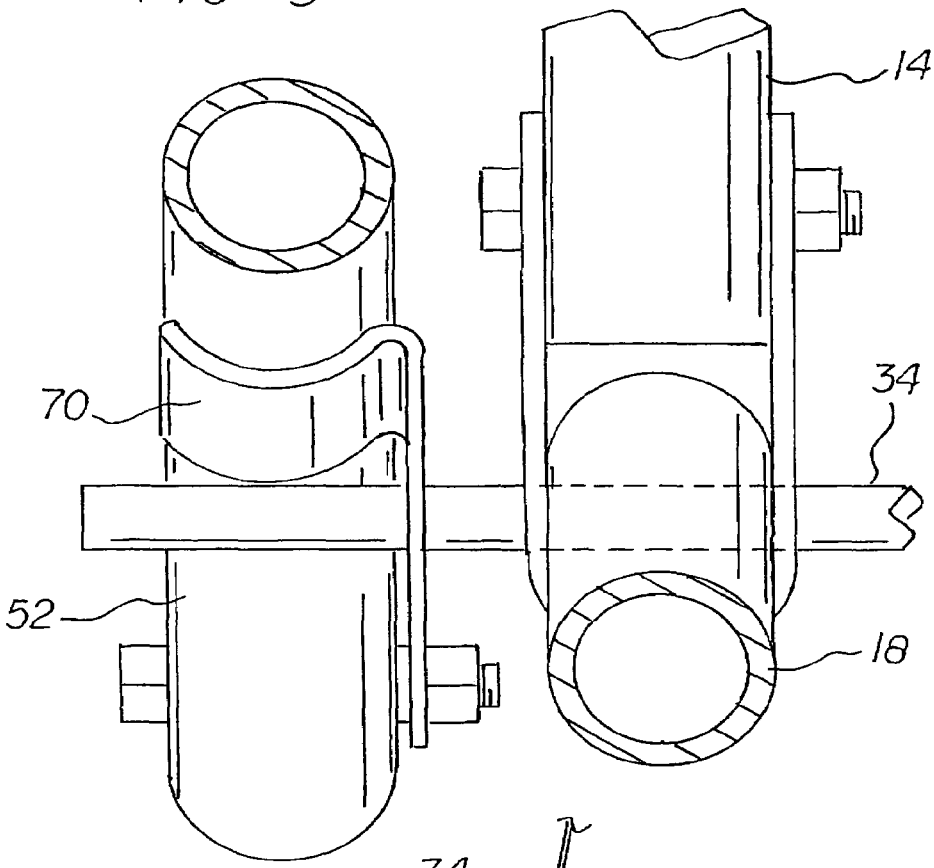
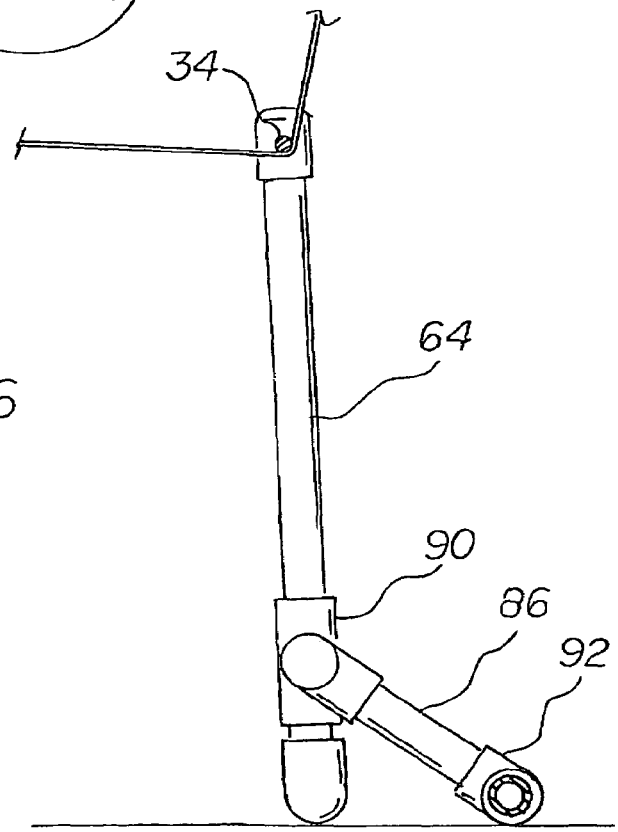
FIG 6

ENLARGED FOLDABLE CHAIR SYSTEM

BACKGROUND OF THE INVENTION

1. Field of the Invention

The present invention relates to an enlarged foldable chair system and more particularly pertains to seating a plurality of people on a lawn and beak and like locations in a comfortable and convenient manner.

2. Description of the Prior Art

The use of chairs of known designs and configurations is known in the prior art. More specifically, chairs of known designs and configurations previously devised and utilized for the purpose of seating people through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,858,254 issued May 22, 1932 to Uline relates to a foldable settee. U.S. Pat. No. 2,704,569 issued Mar. 22, 1955 to Salzer relates to a chair. U.S. Pat. No. 5,529,375 issued Jun. 25, 1996 to English relates to a beach chair love seat. U.S. Pat. No. 5,570,928 issued Nov. 5, 1996 to Staunton relates to joined concertina chairs. Lastly, U.S. Pat. No. 6,231,2001 issued May 15, 2001 to Zheng relates to a foldable dual-chair.

While these devices fulfill their respective, particular objectives and requirements, the aforementioned patents do not describe an enlarged foldable chair system that allows seating a plurality of people on a lawn and beak and like locations in a comfortable and convenient manner.

In this respect, the enlarged foldable chair system according to the present invention substantially departs from the conventional concepts and designs of the prior art, and in doing so provides an apparatus primarily developed for the purpose of seating a plurality of people on a lawn and beak and like locations in a comfortable and convenient manner.

Therefore, it can be appreciated that there exists a continuing need for a new and improved enlarged foldable chair system which can be used for seating a plurality of people on a lawn and beak and like locations in a comfortable and convenient manner. In this regard, the present invention substantially fulfills this need.

SUMMARY OF THE INVENTION

In view of the foregoing disadvantages inherent in the known types of chairs of known designs and configurations now present in the prior art, the present invention provides an improved enlarged foldable chair system. As such, the general purpose of the present invention, which will be described subsequently in greater detail, is to provide a new and improved enlarged folable chair system and method which has all the advantages of the prior art and none of the disadvantages.

To attain this, the present invention essentially comprises an enlarged foldable chair system. First provided is a seat section. The seat section is positionable in an essentially horizontal plane during use. The seat section has a periphery of a U-shaped tube. The periphery is formed of a central forward tube and parallel lateral tubes. The periphery is further formed with free ends. The free ends constitute the rearward end of the seat section. The central forward tube is about 40 inches in length.

A back section is provided. The back section is positionable in an essentially vertical plane during use. The back section has a periphery of a U-shaped tube. The periphery formed of a central upper tube and parallel lateral tubes. The periphery is further formed with free ends. The free ends constitute the lower end of the back section. The central upper tube is about 40 inches in length.

Provided next is a rod. The rod forms the rear end of the seat section and the lower end of the back section. The rod pivotally supports the seat section and the back section.

Also provided are a plurality of flexible support straps including longitudinal straps coupling the forward tube of the seat section and the upper tube of the back section and the rod. Also included are interwoven latitudinal straps coupling the lateral tubes of the seat and back sections.

A pair of parallel arm rests is provided. The arm rests are located above the seat section and laterally exterior thereof. Each arm rest has a forward pivot point, an intermediate pivot point and a rearward pivot point.

A U-shaped tubular forward support is provided. The forward support has a central extent. The central extent is positionable on a support surface. The forward support has end extents. The end extents have free ends. The free ends are pivotably coupled to the forward pivot points of the arm rests. The end extents have intermediate extents. The intermediate extents are pivotably coupled to the lateral tubes of the seat section adjacent to the forward tube.

Provided next is a U-shaped tubular rearward support. The rearward support has a central extent. The central extent is positionable on a support surface. The rearward support has end extents. The end extents have free ends. The free ends are pivotably coupled to the intermediate pivot points of the arm rests. The end extents have intermediate extents. The intermediate extents have connectors. The connectors have upper ends. The upper ends are pivotally coupled to the rod. The lower ends are pivotably coupled to an intermediate extent of the lateral tubes of the intermediate support.

Two tubular front braces are provided. Each front brace is formed of a T-shaped upper component. The upper end of the upper component is rotatably coupled to the forward tube of the seat section. Each front brace is formed of an inverted T-shaped lower component. The lower end of the lower component is rotatably coupled to the central extent of the forward support. The upper and lower components have free ends. The free end of the upper component is slidably received within the free end of the lower component. Each front brace is located about 12 inches from an adjacent lateral tube of the seat section for relative movement during reconfiguring between an operative and collapsed orientation.

Further provided is a tubular rear brace. The rear brace has a U-shaped configuration. The rear brace has a central extent. The central extent is positionable on a support surface between the front and rear supports. The rear brace has parallel side extents. The free upper ends of the side extents are pivotably secured to the rod about 12 inches from an adjacent lateral tube of the seat section for relative movement during reconfiguring between an operative and collapsed orientation.

Provided last are two supplemental supports. Each suplemental support is formed of a T-shaped slider and an I-shaped rotator. Each slider is adapted to slide upon a side extent of the rear brace. Each slider has an outwardly extending stub. A cap is provided. The stub terminates at the cap. Each rotator has an upper end. The upper end of the rotator is rotatably supported on a stub. The lower end of the rotator is rotatably supported on the central extent of the forward support for relative movement during reconfiguring between an operative and collapsed orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved enlarged foldable chair system which has all of the advantages of the prior art chairs of known designs and configurations and none of the disadvantages.

It is another object of the present invention to provide a new and improved enlarged foldable chair system which may be easily and efficiently manufactured and marketed.

It is further object of the present invention to provide a new and improved enlarged foldable chair system which is of durable and reliable constructions.

An even further object of the present invention is to provide a new and improved enlarged foldable chair system which is susceptible of a low cost of manufacture with regard to both materials and labor, and which accordingly is then susceptible of low prices of sale to the consuming public, thereby making such enlarged foldable chair system economically available to the buying public.

Even still another object of the present invention is to provide an enlarged foldable chair system for seating a plurality of people on a lawn and beak and like locations in a comfortable and convenient manner.

Lastly, it is an object of the present invention to provide a new and improved enlarged foldable chair system. A seat section and a back section are provided with a rod pivotably forming the rear end of the seat section and the lower end of the back section. A pair of parallel arm rests are also provided. A forward support has a central extent and end extents pivotably coupled to forward pivot points of the arm rests. A rearward support has a central extent and end extents coupled to intermediate pivot points of the arm rests. A front brace is formed of an upper component rotatably coupled to the seat section and a lower component rotatably coupled to the forward support.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of an enlarged foldable chair system constructed in accordance with the principles of the present invention.

FIG. 2 is a front elevational of the system taken along line 2—2 of FIG. 1.

FIG. 5 is a cross sectional view taken along line 5—5 of FIG. 4.

FIG. 6 is a cross sectional view taken along line 6—6 of FIG. 6.

The same references numerals refer to the same parts throughout the various Figures.

DESCRIPTION OF THE PREFERRED EMBODIMENT

Figure 3:
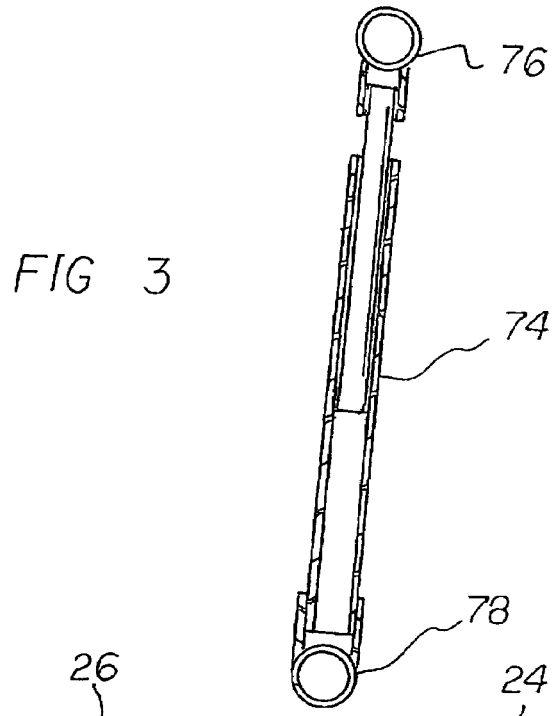
FIG. 3 is a cross sectional view taken along line 3—3 of FIG. 2.
Figure 4:
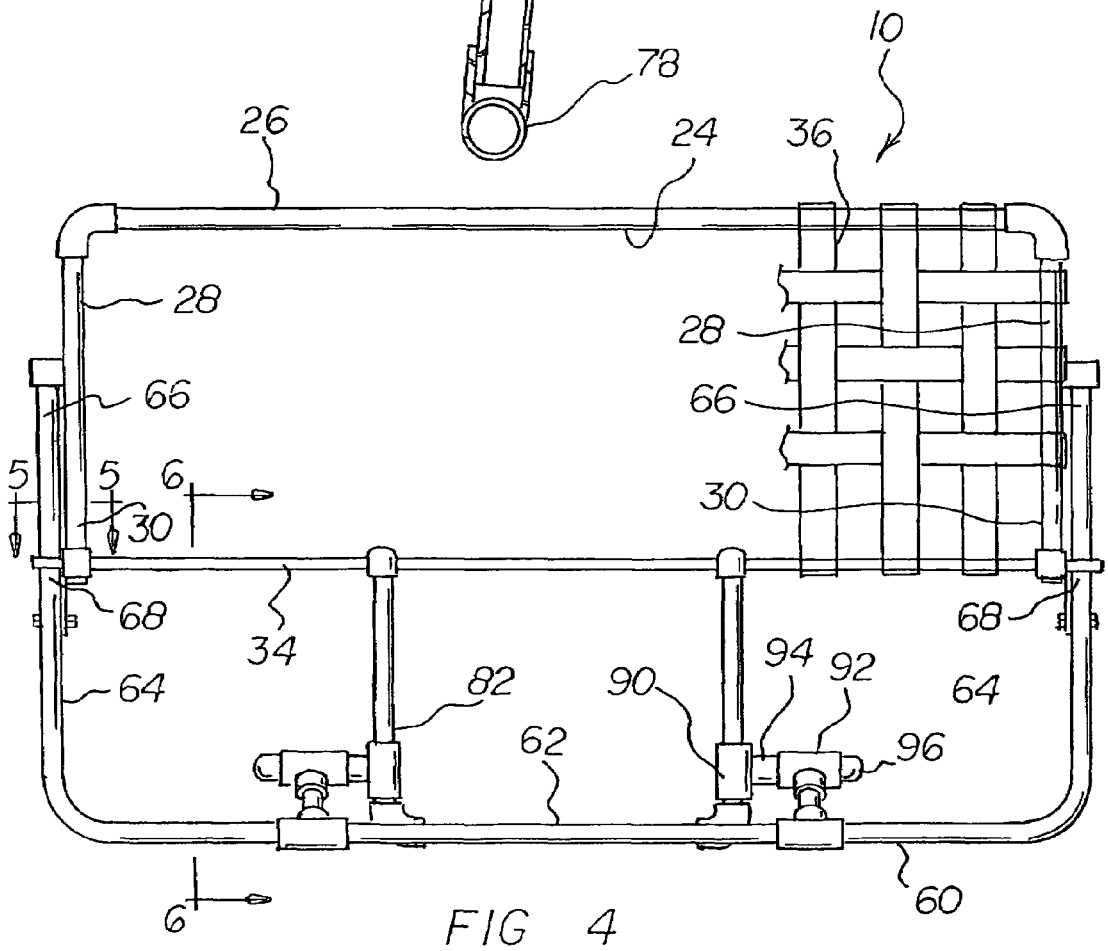
FIG. 4 is a rear elevational view taken along lone 4—4 of FIG. 1.
Figure 7:
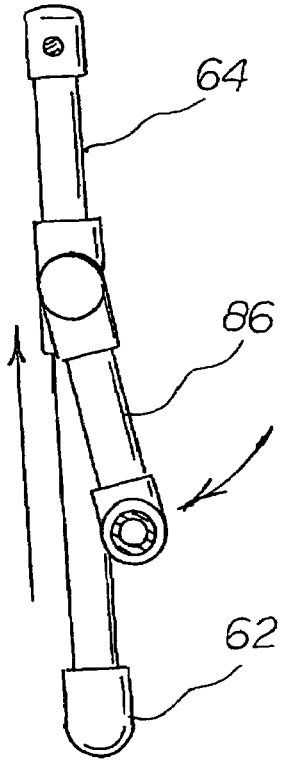
FIG. 7 is a view of the rear legs shown in FIG. 6 but in the folded orientation.

With reference now to the drawings, and in particular to FIG. 1 thereof, the preferred embodiment of the new and improved enlarged foldable chair system embodying the principles and concepts of the present invention and generally designated by the reference numeral 10 will be described.

The present invention, the enlarged foldable chair system 10 is comprised of a plurality of components. Such components in their broadest context include arm rests, a forward support, a rearward support and front braces. Such components are individually configured and correlated with respect to each other so as to attain the desired objective.

First provided is a seat section 14. The seat section is positionable in an essentially horizontal plane during use. The seat section has a periphery formed of a U-shaped tube. The periphery is formed of a central forward tube 16 and parallel lateral tubes 18. The periphery is further formed with free ends 20. The free ends constitute the rearward end of the seat section. The central forward tube is about 40 inches in length.

A back section 24 is provided. The back section is positionable in an essentially vertical plane during use. The back section has a periphery formed of a U-shaped tube. The periphery formed of a central upper tube 26 and parallel lateral tubes 28. The periphery is further formed with free ends 30. The free ends constitute the lower end of the back section. The central upper tube is about 40 inches in length.

Provided next is a rod 34. The rod forms the rear end of the seat section and the lower end of the back section. The rod pivotally supports the seat section and the back section.

A plurality of flexible support straps 36 include longitudinal straps coupling the forward tube of the seat section and the upper tube of the back section and the rod. Also included are interwoven latitudinal straps coupling the lateral tubes of the seat and back sections.

A pair of parallel arm rests 38 is provided. The arm rests are located above the seat section and laterally exterior thereof. Each arm rest has a forward pivot point 40, an intermediate pivot point 42 and a rearward pivot point 44.

A U-shaped tubular forward support 48 is provided. The forward support has a central extent 50. The central extent is positionable on a support surface. The forward support has end extents 52. The end extents have free ends 54. The free ends are pivotably coupled to the forward pivot points of the arm rests. The end extents have intermediate extents 56. The intermediate extents are pivotably coupled to the lateral tubes of the seat section adjacent to the forward tube.

Provided next is a U-shaped tubular rearward support 60. The rearward support has a central extent 62. The central extent is positionable on a support surface. The rearward support has end extents 64. The end extents have free ends 66. The free ends are pivotably coupled to the intermediate pivot points of the arm rests. The end extents have intermediate extents 68. The intermediate extents have connectors 70. The connectors have upper ends. The upper ends are pivotally coupled to the rod. The lower ends are pivotably coupled to an intermediate extent of the lateral tubes of the intermediate support.

Two tubular front braces 74 are provided. Each front brace is formed of a T-shaped upper component 76. The upper end of the upper component is rotatably coupled to the forward tube of the seat section. Each front brace is formed of an inverted T-shaped lower component 78. The lower end of the lower component is rotatably coupled to the central extent of the forward support. The upper and lower components have free ends. The free end of the upper component is slidably received within the free end of the lower component. Each front brace is located about 12 inches from an adjacent lateral tube of the seat section for relative movement during reconfiguring between an operative and collapsed orientation.

Further provided is a tubular rear brace 82. The rear brace has a U-shaped configuration. The rear brace has a central extent 84. The central extent is positionable on a support surface between the front and rear supports. The rear brace has parallel side extents 86. The free upper ends of the side extents are pivotably secured to the rod about 12 inches from an adjacent lateral tube of the seat section for relative movement during reconfiguring between an operative and collapsed orientation.

Figure 8:
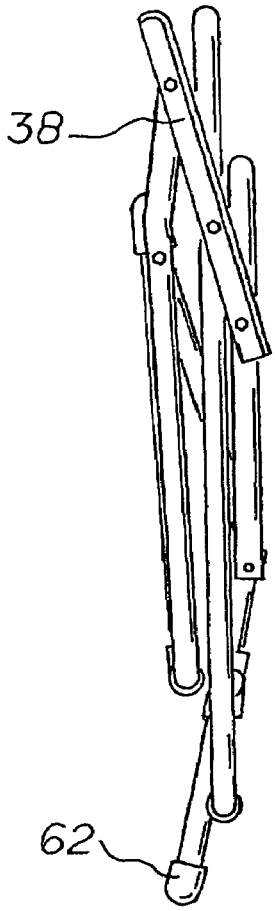
FIG. 8 is a view of the system shown in FIG. 1 but in the folded orientation.

Provided last are two supplemental supports. Each supplemental support is formed of a T-shaped slider 90 and an I-shaped rotator 92. Each slider is adapted to slide upon a side extent of the rear brace. Each slider has an outwardly extending stub 94. A cap 96 is provided. The stub terminates at the cap. Each rotator has an upper end. The upper end of the rotator is rotatably supported on a stub. The lower end of the rotator is rotatably supported on the central extent of the forward support for relative movement during reconfiguring between an operative orientation as shown in FIG. 1 and a collapsed orientation as shown in FIG. 8.

In the operative orientation, a plurality of people may sit on the seat section with their backs on the back section. In the collapsed or inoperative orientation, the tubes are configured in an essentially common planar orientation whereby the system may be lifted and carried by holding onto the central extent of the rear brace.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the Unites States is as follows:

1. An enlarged foldable chair system comprising:

a seat section and a back section with a rod forming the rear end of the seat section and the lower end of the back section, the rod pivotally supporting the seat section and the back section;

a pair of parallel arm rests;

a forward support with a central extent and end extents pivotably coupled to forward pivot points of the arm rests;

a rearward support with a central extent and end extents pivotably coupled to intermediate pivot points of the arm rests; and a front brace formed of an upper component rotatably coupled to the seat section, the front brace including two tubular front braces each formed of a T-shaped upper component with an upper and rotatably coupled to the forward tube of the seat section and an inverted T-shaped and a lower component with a lower end rotatably coupled to the central extent of the forward support, the upper and lower components having free ends with the free end of the upper component being slidably received within the free end of the lower component, each front brace being located about 12 inches from an adjacent lateral tube of the seat section for relative movement during reconfiguring between an operative and collapsed orientation.

2. The system as set forth in claim 1 and further including a tubular rear brace having a U-shaped configuration with a central extent positionable on a support surface between the front and rear supports and parallel side extents with free upper ends pivotably secured to the rod about 12 inches from an adjacent lateral tube of the seat section for relative movement during reconfiguring between an operative and collapsed orientation.

3. The system as set forth in claim 2 and further including:

two supplemental supports each formed of a T-shaped slider and an I-shaped rotator, each slider adapted to slide upon a side extent of the rear brace with an outwardly extending stub terminating in a cap, each rotator having an upper end rotatably supported on a stub and a lower end rotatably supported on the central extent of the forward support for relative movement during reconfiguring between an operative and collapsed orientation.

4. An enlarged foldable chair system for seating a plurality of people on a lawn and beach and like locations in a comfortable and convenient manner comprising, in combination, comprising:

a seat section positionable in an essentially horizontal plane during use, the seat section having a periphery formed of a U-shaped tube with a central forward tube and parallel lateral tubes with free ends constituting the rearward end of the seat section, the central forward-tube being about 40 inches in length;

a back section positionable in an essentially vertical plane during use, the back section having a periphery formed of a U-shaped tube with a central upper tube and parallel lateral tubes with free ends constituting the lower end of the back section, the central upper tube being about 40 inches in length;

a rod forming the rear end of the seat section and the lower end of the back section, the rod pivotally supporting the seat section and the back section;

a plurality of flexible support straps including longitudinal straps coupling the forward tube of the seat section and the upper tube of the back section and the rod and also including interwoven latitudinal straps coupling the lateral tubes of the seat and back sections;

a pair of parallel arm rests located above the seat section and laterally exterior thereof, each arm rest having a forward pivot point, an intermediate pivot point and a rearward pivot point;

a U-shaped tubular forward support with a central extent positionable on a support surface and end extents, the end extents having free ends pivotably coupled to the forward pivot points of the arm rests, the end extents having intermediate extents pivotably coupled to the lateral tubes of the seat section adjacent to the forward tube;

a U-shaped tubular rearward support with a central extent positionable on a support surface and end extents, the end extents having free ends pivotably coupled to the intermediate pivot points of the arm rests, the end extents having intermediate extents with connectors having upper ends pivotally coupled to the rod and lower ends pivotably coupled to an intermediate extent of the lateral tubes of the intermediate support;

two tubular front braces each formed of a T-shaped upper component with an upper end rotatably coupled to the forward tube of the seat section, the front braces each also formed of an inverted T-shaped lower component with a lower end rotatably coupled to the central extent of the forward support, the upper and lower components having free ends with the free end of the upper component being slidably received within the free end of the lower component, each front brace being located about 12 inches from an adjacent lateral tube of the seat section for relative movement during reconfiguring between an operative and collapsed orientation;

a tubular rear brace having a U-shaped configuration with a central extent positionable on a support surface between the front and rear supports and parallel side extents with free upper ends pivotably secured to the rod about 12 inches from an adjacent lateral tube of the seat section for relative movement during reconfiguring between an operative and collapsed orientation; and two supplemental supports each formed of a T-shaped slider and an I-shaped rotator, each slider adapted to slide upon a side extent of the rear brace with an outwardly extending stub terminating in a cap, each rotator having an upper end rotatably supported on a stub and a lower end rotatably supported on the central extent of the forward support for relative movement during reconfiguring between an operative and collapsed orientation.

* * * * *